US006029747A

United States Patent [19]

Morrell et al.

[11] Patent Number: 6,029,747

[45] Date of Patent: Feb. 29, 2000

[54] THROUGH-TUBING LATERAL RE-ENTRY

[75] Inventors: Terence Robert Morrell; Robert Martin Norris, both of Dorset, United Kingdom

[73] Assignee: Tuboscope I/P Inc., Houston, Tex.

[21] Appl. No.: 09/011,690

[22] PCT Filed: Aug. 13, 1996

[86] PCT No.: PCT/GB96/01978

§ 371 Date: Sep. 23, 1998

§ 102(e) Date: Sep. 23, 1998

[87] PCT Pub. No.: WO97/07318

PCT Pub. Date: Feb. 27, 1997

[30] Foreign Application Priority Data

Aug. 14, 1995 [GB] United Kingdom ..... 9516632

[51] Int. Cl.[7] ..... E21B 7/08

[52] U.S. Cl. ..... 166/313; 166/117.6; 166/384

[58] Field of Search ..... 166/50, 117.5, 166/117.6, 181, 313, 384

[56] References Cited

U.S. PATENT DOCUMENTS 2,797,893 7/1957 McCune et al. ..... 116/117.5 X
5,195,591 3/1993 Blount et al. .
5,222,554 6/1993 Blount et al. .
5,311,936 5/1994 McNair et al. ..... 166/117.6 X

FOREIGN PATENT DOCUMENTS 0 664 372 7/1995 European Pat. Off. .
WO 94/03697 2/1994 WIPO .

*Primary Examiner*—Roger Schoeppel
*Attorney, Agent, or Firm*—Finnegan, Henderson, Farabow, Garrett & Dunner, L.L.P.

[57] ABSTRACT

A method for allowing entry of an existing lateral offshoot from a main borehole, without removal of downstream completion tubing from the mai the use of both a liner (14) and a whipstock (28) inserted through the completion tubing (10) to a position within the liner (14), characterized in that an intermediate device (18) has been provided which, in use, is located between the liner (14) and the whipstock (28) so that the whipstock (28) merely needs to locate with the intermediate device (18) rather than the liner (14), the intermediate device (18) preferably having a passageway extending linearly therethrough, and the whipstock (28) preferably being provided with locator keys which are of different profile for different intermediate devices (18).

10 Claims, 2 Drawing Sheets

THROUGH-TUBING LATERAL RE-ENTRY

The present invention relates to through-tubing lateral re-entry, by which is meant the ability to enter an existing lateral offshoot from a main borehole without removal of downstream completion tubing from the main borehole.

The need for such an ability has arisen because of the increasingly common practice of improving well output by drilling a lateral bore, or more often multiple lateral bores, from a common main borehole in order to gain access to different levels or zones of an oil or gas reservoir.

Typically, the main borehole, at least in the region of the multi-lateral offshoots, can be deviated from the vertical plane or even horizontal, and the multi-lateral offshoots can themselves be deviated from the vertical plane or even horizontal.

This means that the well needs to be serviced by coiled tube technology relying on hydraulics, rather than by traditional wireline technology relying on gravity.

It is known for a lateral bore to be drilled by providing a steel liner for the main borehole with a window which is closed by a softer material such as fibreglass. The liner is also provided upstream of the window with a latch down collar having an orienting device. Using conventional drilling technology, the steel liner is lowered into position and then fixed in position by cement, with the window facing in a predetermined direction.

A whipstock is run down through the liner until an orienting device on the whipstock locates with the orienting device on the liner to latch and hold the whipstock at a desired orientation.

Next, a drill string is run down through the liner and is deflected by the whipstock to drill through the softer material closing the window before drilling into the surrounding stratum. After the lateral bore has been drilled, the drill string is withdrawn and then the whipstock is retrieved leaving the latch down collar with its orienting device. Finally, conventional completion tubing is run down through the main borehole to a desired position downstream of the lateral bore.

There are a number of reasons why it would be desirable to be able to re-enter a selected lateral bore after it has been drilled.

For example, there may be a wish for a particular lateral bore to be:

a) plugged and isolated from the main borehole;

b) acid washed or stimulated to remove unwanted mud from the lateral bore or the surrounding stratum;

c) subjected to logging to give a series of readings indicating the presence or absence of oil or water; or d) controlled by opening or closing a device, such as a slotted supporting sleeve, at an interface of the lateral bore and the surrounding stratum.

There are also, however, a number of reasons why it would not be desirable to remove the downstream completion tubing—not only does the downstream completion tubing protect the main borehole casing from corrosive well fluids and provide total control over the well fluids, but removal in a so-called workover can cost up to $1,000,000.

It has recently been proposed that a special small diameter whipstock be deployed through the completion tubing and then oriented directly in the large diameter liner to allow through-tubing lateral re-entry.

According to one aspect of the present invention, however, a method is provided for allowing entry of an existing lateral offshoot from a main borehole, without removal of downstream completion tubing from the main borehole, comprising the use of both a liner and a whipstock inserted through the completion tubing to a position within the liner, characterised in that an intermediate device has been provided which, in use, is located between the liner and the whipstock so that the whipstock merely needs to locate with the intermediate device rather than the liner.

Other aspects of the present invention reside in the provision of an intermediate device for use in the method and of a well assembly resulting from use of the method.

Such an intermediate device needs to be located in the liner before the completion tubing is located in the liner, and a separate intermediate device needs to be associated with each of the lateral bores for which re-entry is to be required.

Nevertheless, an advantage of the present invention is that the whipstock can be of a simple construction, because it merely needs to locate with the intermediate device, whose inner diameter can be chosen to be compatible with that of the completion tubing, rather than needing to locate with the much larger inner diameter of the liner.

A further advantage of the present invention, when there are multi-lateral offshoots, is that the whipstock can be arranged to recognise each of the intermediate devices sequentially, and locate with just a pre-selected intermediate device to provide access to a pre-selected lateral offshoot.

Preferably, in order to avoid potential disruption caused by running tool snagging at bends and kinks, the intermediate device has a passageway extending linearly therethrough.

Indeed, the intermediate device is preferably in the form of a hollow sleeve. It may be locatable by packers and orientable by a gyroscope. Preferably, however, the intermediate device has locating, latching and orienting components for co-operation with complementary components provided by the liner.

The liner may also be provided with a protrusion, such as a polished liner nipple, upstream of its window for sealing abutment with the outside of the intermediate device. Preferably, however, the liner is also provided with a similar protrusion downstream of its window, for sealing abutment with the outside of the intermediate device. Thus, the intermediate device needs to be itself provided with a window.

The above-noted orientation ensures that the window in the intermediate device is aligned with the window in the liner.

Preferably, the whipstock has locating, latching and orienting components for co-operation with complementary components provided by the intermediate device.

As already indicated, the whipstock is adapted to recognise each of the intermediate devices sequentially to enable locating, latching and orienting with just a pre-selected intermediate device to provide access to a pre-selected lateral offshoot.

Indeed, said recognition preferably involves the use of locator keys of different profile rather than passageways of different diameter. The locator keys on the whipstock can stop and latch out when they see a matching profile on the intermediate device. By avoiding the use of passageways of progressively decreasing diameter, there are no restrictions on the number of intermediate devices before running tool progress through the passageways is blocked.

The locating, latching and orienting components provided by the whipstock can all be of known type including, in addition to the locator keys, a trigger for moving along a helix presented by the intermediate device to orient the deflecting surface of the whipstock, which can also have a known type of releasable connection with the running tool.

The intermediate device preferably also has parts thereof adapted for co-operation with plugs and an isolation sleeve to enable the lateral offshoot to be sealed off from the main borehole.

An example of through-tubing lateral re-entry according to the present invention is shown in the accompanying drawings wherein.

In the accompanying drawings, conventional completion tubing 10 is shown extending through a main borehole casing 12 into a liner 14 from which extend two lateral bores 16*a*, 16*b*.

Figure 1:
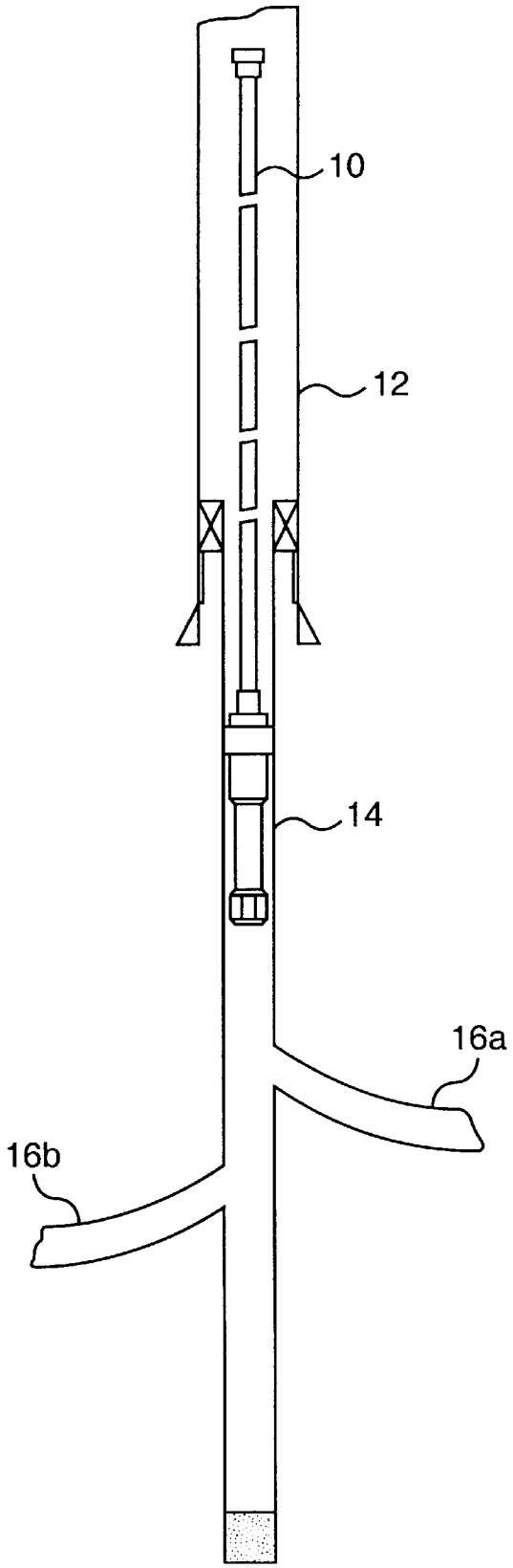
FIG. 1 shows a typical oil well completion with two lateral bores.

Although the liner 14 is shown in a vertical position in FIG. 1 it is more likely in practice to extend horizontally.

Figure 2:
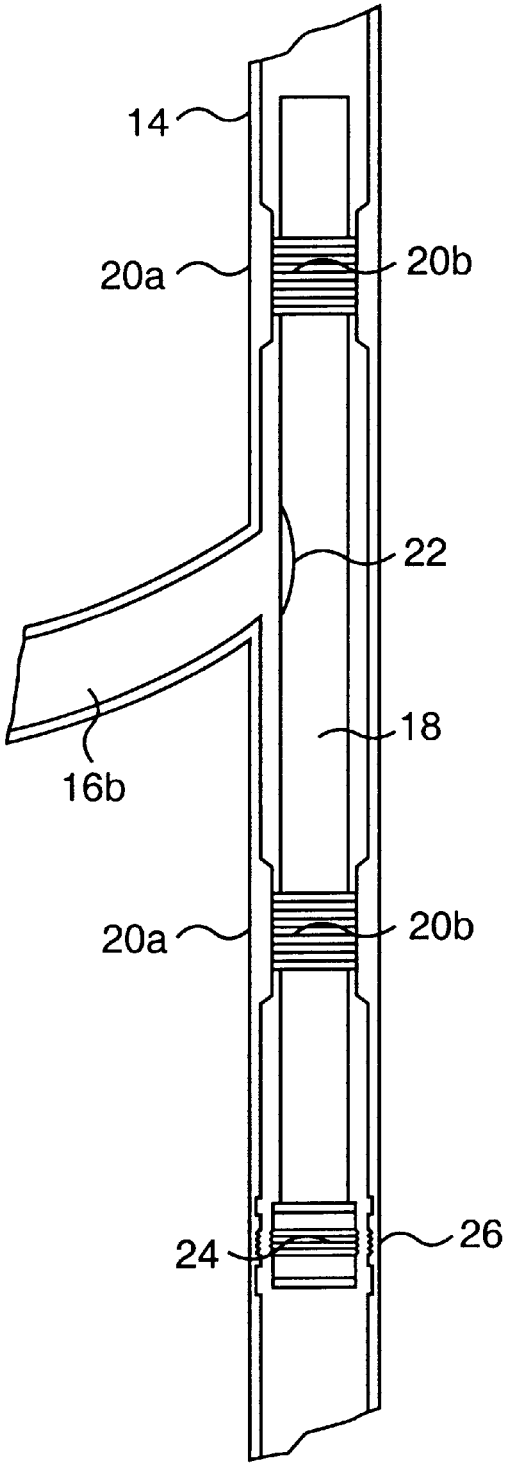
FIG. 2 shows an intermediate device associated with one of the lateral bores of FIG. 1.
Figure 3:
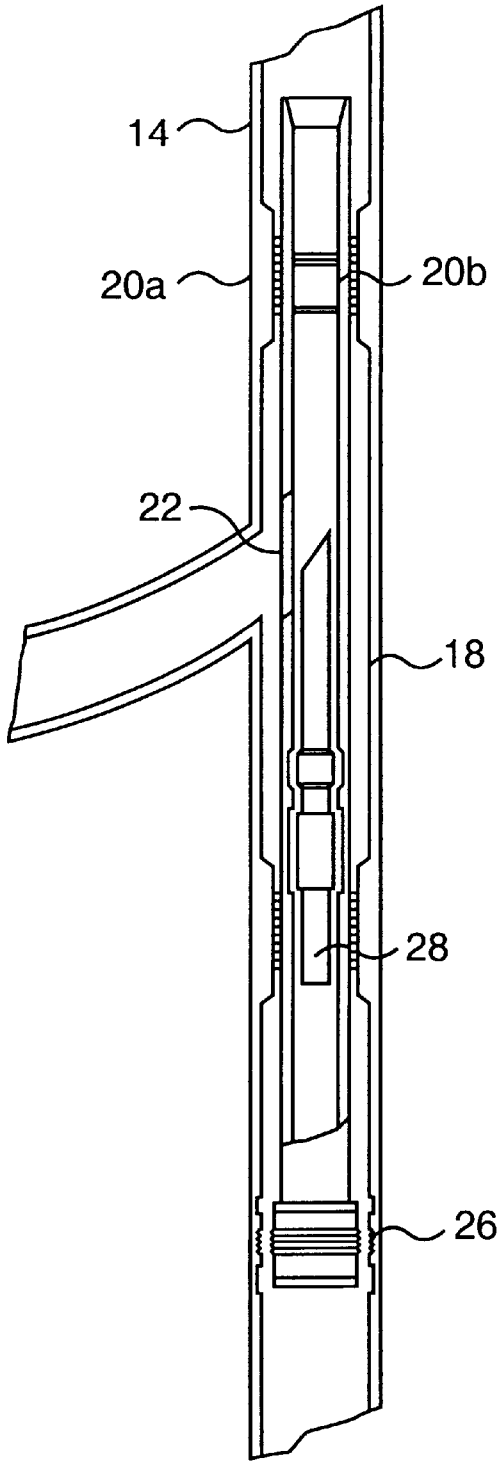
FIG. 3 shows a whipstock associated with the intermediate device of FIG. 2.

As shown in FIG. 2, an intermediate device 18 is located in the liner 14 opposite the lateral bore 16*b*. The liner 14 is formed with a pair of inwardly projecting protrusions 20*a* for abutment with complementary parts 20*b* of the intermediate device 18. The intermediate device 18 is also formed with a window 22 as well as a lower (upstream) locating, latching and orienting device 24 for co-operation with a latch down collar and orienting device 26 provided by the liner 14.

A whipstock 28 can be pushed by coiled tubing, acting as a running tool, through the completion tubing 10 and into the lower end of the intermediate device 18. The whipstock 28 can now be located, latched and oriented by co-operation of complementary components provided by the whipstock 28 and the intermediate device 18 when the coiled tubing is pulled upwards.

It will be appreciated that it is now possible for further operating equipment to be run through the completion tubing 10 and be deflected by the whipstock 28 thereby achieving through-tubing lateral re-entry.

We claim:

1. A method for allowing entry of an existing lateral offshoot from a main borehole, without removal of downstream completion tubing from the main borehole, comprising the use of both a liner (14) and a whipstock (28) inserted through the completion tubing (10) to a position within the liner (14), characterised in that an intermediate device (18) comprising a hollow sleeve being linear along an entire length thereof and having a window (22) positioned between a deflecting surface of the whipstock (28) and an associate window through the liner (14), the intermediate device (18) having at least one part (20*b*) thereof adapted for sealing abutment with a protrusion (20*a*) projecting inwardly of the liner (14) so that the whipstock (28) locates with the intermediate device (18) rather than the liner (14) to allow entry of an existing lateral offshoot without removal of the completion tubing.

2. A method according to claim 1, characterised in that the intermediate device (18) has parts thereof adapted for co-operation with plugs and an isolation sleeve to enable the lateral offshoot to be sealed off from the main borehole.

3. A method according to claim 1, characterised in that the intermediate device (18) has locating, latching and orienting components (24) for cooperation with complementary components (26) provided by the liner (14).

4. A method according to claim 1, characterised in that the intermediate device (18) has a passageway extending linearly therethrough.

5. A method according to claim 1, characterised in that the whipstock (28) has locating, latching and orienting components for co-operation with complementary components provided by the intermediate device (18).

6. A method according to claim 5, characterised in that the whipstock (28) is adapted to recognise each of the intermediate devices (18) sequentially to enable locating, latching and orienting with just a pre-selected intermediate device (18) to provide access to a pre-selected lateral offshoot (16*a*, 16*b*).

7. A method according to claim 6, characterised in that said recognition involves the use of locator keys of different profile rather than passageways of different diameter.

8. A method according to claim 1, characterised in that a separate intermediate device (18) is provided for each of a plurality of lateral offshoots (16*a*, 16*b*).

9. A method according to claim 8, characterised in that the whipstock (28) is adapted to recognise each of the intermediate devices (18) sequentially to enable locating, latching and orienting with just a pre-selected intermediate device (18) to provide access to a pre-selected lateral offshoot (16*a*, 16*b*).

10. A method according to claim 9, characterised in that said recognition involves the use of locator keys of different profile rather than passageways of different diameter.

* * * * *

UNITED STATES PATENT AND TRADEMARK OFFICE

CERTIFICATE OF CORRECTION

PATENT NO. : 6,029,747

DATED : February 29, 2000

INVENTOR(S) : Terence Robert Morrell et al.

It is certified that error appears in the above-identified patent and that said Letters Patent is hereby corrected as shown below:

IN THE ABSTRACT:

Line 3 of the Abstract, delete "mai" and insert --main borehole, comprising--.

Signed and Sealed this

Twenty-first Day of November, 2000

*Attest:*

Q. TODD DICKINSON

*Attesting Officer*

*Director of Patents and Trademarks*